US006647872B2

(12) United States Patent
Dueck

(10) Patent No.: US 6,647,872 B2
(45) Date of Patent: Nov. 18, 2003

(54) CUTTER FOR A MEASURED LENGTH OF SHEET MATERIAL

(76) Inventor: Raymond Dueck, Box 700, Arborg, Manitoba (CA), R0C 0A0

( * ) Notice: Subject to any disclaimer, the term of this patent is extended or adjusted under 35 U.S.C. 154(b) by 64 days.

(21) Appl. No.: 10/074,127

(22) Filed: Jan. 31, 2002

(65) Prior Publication Data

US 2003/0143013 A1 Jul. 31, 2003

(51) Int. Cl.[7] ..... B41F 13/56

(52) U.S. Cl. ..... 101/73; 101/226; 101/227; 242/527.1; 242/595.1; 83/614; 83/937; 400/621

(58) Field of Search ..... 242/527.5, 535.1, 242/538.2, 542.2, 595.1; 83/614, 618, 936, 937, 941; 101/171, 224, 73, 226, 227; 400/621

(56) References Cited

U.S. PATENT DOCUMENTS 3,814,013 A * 6/1974 Strauss et al. ..... 101/121
4,013,006 A * 3/1977 Burrell et al. ..... 101/227
4,157,683 A * 6/1979 Norris ..... 101/211
4,809,921 A 3/1989 Dueck et al.
5,812,276 A * 9/1998 Jacobs ..... 358/302
5,944,279 A 8/1999 Dueck
6,138,545 A * 10/2000 Dueck ..... 83/614
6,161,792 A * 12/2000 Kayser ..... 242/541.5
6,328,245 B1 * 12/2001 Kastfelt et al. ..... 242/420.3
6,471,154 B1 * 10/2002 Toth ..... 242/421.3

* cited by examiner

*Primary Examiner*—Andrew H. Hirshfeld
*Assistant Examiner*—Dave A. Ghatt
(74) *Attorney, Agent, or Firm*—Adrian D. Battison; Michael R. Williams; Ryan W. Dupuis

(57) ABSTRACT

A cutting machine which dispenses and cuts sheet material includes a carriage on rails for movement parallel to the horizontal rolls carried on a vertical carrousel. The carriage supports a cutting table top and a drive roller at one side for driving the roll of floor covering material on the carrousel in forward direction for feeding the sheet to the table top and in reverse direction for re-winding. A measuring wheel and electric eye for detecting the presence of the material are located on the table top. A sensor is provided to detect if the measuring wheel is de-activated during use. A control unit includes a printer and is arranged to cause measurement and feeding of a measured length of the material which is fed to a re-roller on the carriage. When the measured amount is supplied the printer is operated to print a label defining the material and the length but only if the measuring device remained properly active during the measuring process to ensure the length is accurate and not distorted by error or deliberately.

16 Claims, 2 Drawing Sheets

CUTTER FOR A MEASURED LENGTH OF SHEET MATERIAL

The present invention relates to improvements to cutting apparatus for cutting sheet materials, particularly but not exclusively of the type for use with a rolled supply of floor covering material.

BACKGROUND

Devices used for cutting carpet, vinyl flooring, and other floor covering materials are known. These devices can be as simple as a rack for supporting a roll of floor covering material adjacent a cutting surface such as a floor or table top or may be complex machines. In the simple case where a rack and cutting surface are used the floor covering material is dispensed from the rack onto a cutting surface where it is cut by an individual with a knife. After cutting the floor covering material is manually re-rolled. One disadvantage of this method is that large areas are required to lay out the floor covering material during cutting. A second disadvantage is that if the floor covering material is cut on a floor the floor covering material can be damaged by contact with materials on the floor.

More complex apparatus for performing this task are also known. One example is shown in U.S. Pat. No. 4,809,921 issued Mar. 4$^{th}$ 1889 of Willie Dueck who is the father of the present inventor. This includes a cradle or rack for supporting the roll of floor covering material to be dispensed, a table top across which the floor covering material is drawn, and a cradle for automatically re-rolling the floor covering material. These components are generally mounted on a frame to keep them raised above the floor at an appropriate height for working. A knife blade arranged for travelling across the table top is usually employed to cut the floor covering material. The knife blade is usually mounted at a fixed angle to the table and moves along a slot running laterally across the table through which the knife blade projects.

Also in U.S. Pat. No. 5,944,279 issued Aug. 31$^{st}$ 1999 to the present inventor is disclosed an improved cutter of this general type where the sheet material is guided and controlled by electric "eyes" which detect the position of the edges of the material. These can primarily be used to calibrate the measuring roller to ensure greater accuracy in the measurement.

SUMMARY

It is one object of the present invention to provide a yet further improved cutter for rolled material such as floor covering material.

According to the present invention there is provided an apparatus for cutting a length of sheet material from a supply of the sheet material comprising:

a carriage;

an unrolling device on the carriage for unrolling a supply roll of the sheet material, the unrolling device being driven such that a front edge of the roll is supplied from the roll;

a table surface on the carriage for receiving the sheet from the unrolling cradle such that the sheet passes longitudinally across the table when fed from the unrolling device;

a sheet driving roller on the carriage for driving the sheet from the unrolling device across the table;

a metering wheel on the carriage arranged to roll on the sheet as it passes from the unrolling cradle and across the table surface for measuring a length of the sheet supplied from the unrolling device;

a de-activation detector responsive to de-activation of the metering wheel;

a cutting knife mounted at the table surface and movable transversely across the table surface to slit the sheet at a position along the sheet to form a cut portion of the sheet having a required length;

a re-rolling cradle on the carriage for receiving the front edge and the cut portion and driven to roll the cut portion from the front edge into a roll for supply of the cut portion;

a material detector mounted in a path of movement of the sheet material from the unrolling device to the re-rolling cradle for detecting passage of a front edge of the sheet material and the presence of the sheet material;

a printer for printing a label recording a length of the sheet material as measured by the metering wheel;

and a control unit responsive to the detection of the front edge by the material detector to commence measuring of the length by the metering wheel to provide a measured length of the material;

the control unit being responsive to the de-activation sensor and arranged to prevent printing of a label recording the length in the event that the de-activation sensor detects a de-activation during measuring of the length.

Preferably the material detector comprises an electric eye.

Preferably the material detector is mounted at the table.

Preferably the material detectors is mounted upstream of and adjacent to the cutting knife.

Preferably the metering wheel is mounted closely adjacent to the cutting knife.

Preferably the metering wheel is mounted immediately prior to the cutting knife.

Preferably the metering wheel is mounted so as to contact one surface of the sheet and there is provided a second contacting wheel mounted to contact an opposed surface of the sheet.

Preferably the de-activation sensor is arranged to detect separation of the metering wheel and the contacting wheel.

Preferably the contacting wheel is mounted on a lever above the table and is movable on the lever to separate the contacting wheel and the measuring wheel.

Preferably the de-activation sensor and the material sensor are mounted on the lever.

Preferably the printer is arranged to generate a machine readable bar code containing information defining the sheet material and the length.

Preferably the control unit is arranged to drive the unrolling device and the sheet driving roller to a predetermined length as measure by the measuring wheel.

Preferably the control unit is arranged to slow a speed of drive of the unrolling device and the sheet driving roller as the length is approached.

Preferably the carriage is arranged to be located adjacent a horizontal roll of the sheet material carried on a carrousel and wherein the unrolling device comprises an elongate horizontal drive roller extending along the roll parallel to an axis of the roll and movable into contact with the roll while the roll remains on the carrousel.

Preferably the carriage is mounted on rails for movement in a direction parallel to the axis of the roll.

Preferably the rive roller is arranged to be driven by the control unit in a reverse direction for re-rolling the sheet material onto the roll on the carrousel.

According to a second aspect of the invention there is provided an apparatus for cutting a length of sheet material from a supply of the sheet material comprising:

a carriage;

an unrolling device on the carriage for unrolling a supply roll of the sheet material, the unrolling device being driven such that a front edge of the roll is supplied from the roll;

a table surface on the carriage for receiving the sheet from the unrolling cradle such that the sheet passes longitudinally across the table when fed from the unrolling device;

a sheet driving roller on the carriage for driving the sheet from the unrolling device across the table;

a metering wheel on the carriage arranged to roll on the sheet as it passes from the unrolling cradle and across the table surface for measuring a length of the sheet supplied from the unrolling device;

a de-activation detector responsive to de-activation of the metering wheel;

a cutting knife mounted at the table surface and movable transversely across the table surface to slit the sheet at a position along the sheet to form a cut portion of the sheet having a required length;

a re-rolling cradle on the carriage for receiving the front edge and the cut portion and driven to roll the cut portion from the front edge into a roll for supply of the cut portion;

a material detector mounted in a path of movement of the sheet material from the unrolling device to the re-rolling cradle for detecting passage of a front edge of the sheet material and the presence of the sheet material;

and a control unit for driving the unrolling device and the sheet driving roller;

wherein the carriage is arranged to be located adjacent a horizontal roll of the sheet material carried on a carrousel and wherein the unrolling device comprises an elongate horizontal drive roller extending along the roll parallel to an axis of the roll and movable into contact with the roll while the roll remains on the carrousel.

BRIEF DESCRIPTION OF THE DRAWINGS

In the accompanying drawings, which illustrate an exemplary embodiment of the present invention.

DETAILED DESCRIPTION

Figure 1:
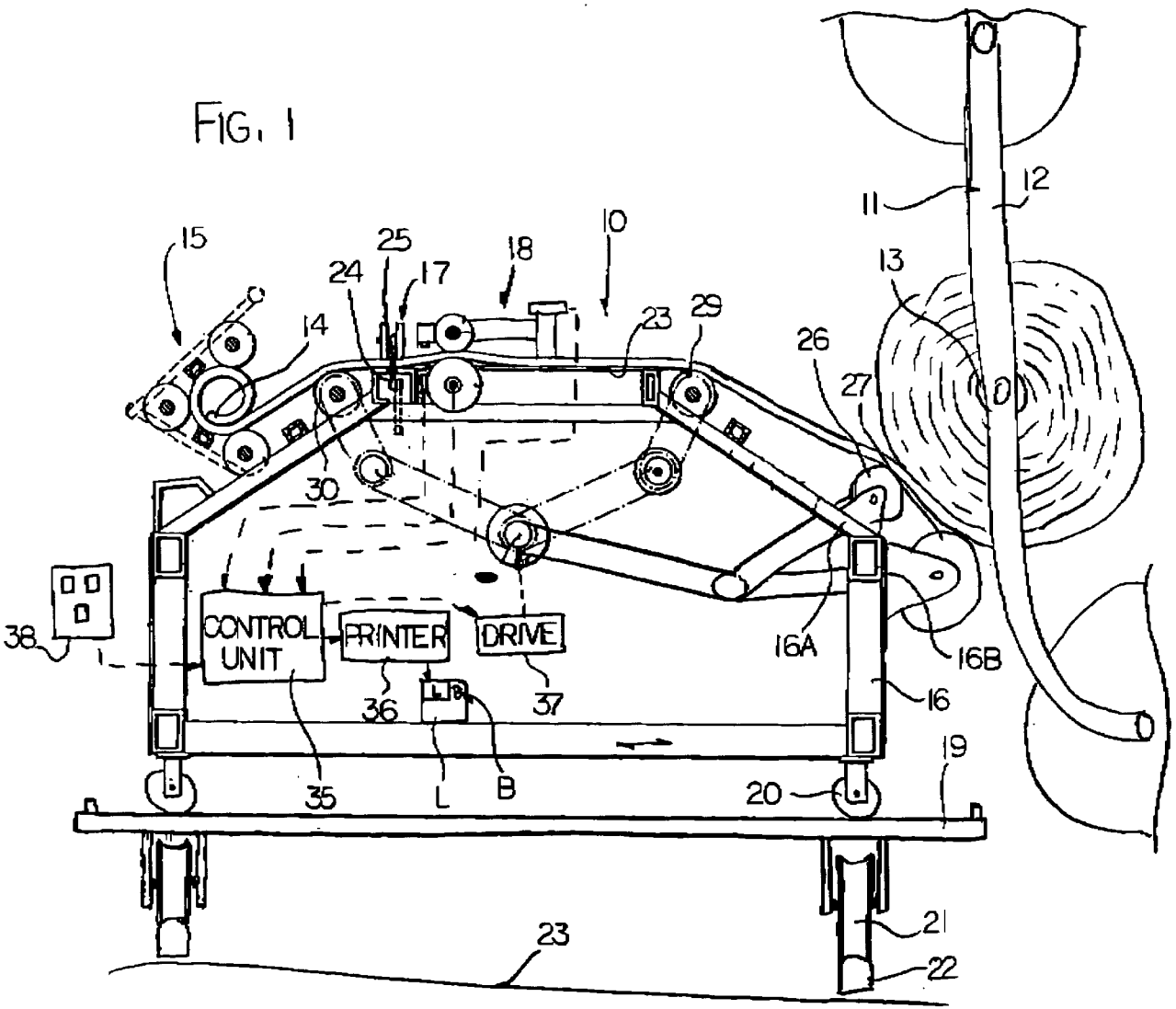
FIG. 1 is a vertical cross sectional view through a cutter for sheet material according to the present invention showing the cutter in association with a roll of the sheet material carried on a separate carousel.

Reference is made to the above patents which show the construction of a cutter and provides many of the details of the device which are used in the machine as described herein. Thus the details previously described are omitted from the present application since these are available to one skilled in the art from the above patents.

The cutter is indicated generally at 10 and is arranged for co-operation with a carousel 11 of a conventional nature. The carousel is of the type which supports rolls of the sheet material on a chain 12 so that the rolls 13 are held with horizontal axes generally parallel at spaced positions around the chain 12. The chain 12 is thus driven around top and bottom chain wheels so that the rolls 13 are moved to the required position on the carousel spaced above the ground and at the front of the carousel for co-operation with the cutter 10. Carousels of this type are of course well known and commercially available.

The cutter therefore provides in general a drive system which transports a front edge 14 of the sheet material on the roll 13 across the cutter to a re-rolling cradle 15 again of a conventional nature described in the above patents.

The cutter 10 comprises a frame 16 which carries the drive elements together with a cutter knife 17 and a metering system 18. The frame 16 is mounted on a sub frame 19 which carries the frame 16 and allows movement of the frame 16 in a direction towards and away from the rolls 13 on rollers 20 provided between the frame 16 and the sub frame 19. Thus the frame 16 can be pulled away from the carousel by rolling relative to the sub frame 19 to allow the carousel to rotate freely without interfering with the cutter. The frame 16 can then be moved manually or driven by suitable propulsion systems to a position at the roll 13 where the drive system of a cutter engages the roll for driving rotation of the roll for feeding and returning the sheet material relative to the roll 13.

The sub frame 19 is carried on wheels 21 which roll on rails 22 carried on the ground 23. Thus the sub frame 19 can be moved along in a direction generally parallel to the axes or rolls 13 from one carousel to a next adjacent carousel. The rails 22 hold the sub frame in position along side the carousel so that forces from the frame 16 pushing the drive mechanism against the roll 13 are communicated back to the sub frame 19 and the rails 22 to hold the frame 16 in fixed position and square relative to the axis of the roll.

The frame 16 defines a table top 23 over which the sheet material from the roll 13 is passed as it passes the metering system 18 and the cutter 17 on its way to the re-rolling system 15. The table top 23 includes a slot 24 for co-operation with the cutter blades of the cutter 17 with a cutter 17 being carried on rollers 25 which pass over the sheet material in the cutting action. The slot 24 is arranged transverse to the table top so that the cutter is operated only to cut across the width of the sheet material when a length of the sheet material has been measured to the required length ready for cutting to the required length and rolling into the re-rolling system 15.

The construction of the cutter is shown in the above patents and alternative arrangements for the cutter can be used. The drive system for the cutter is not shown herein since it is then available to one skilled in the art from the above patents.

The drive system includes main drive rollers 26 and 27 which engage the sheet material on the roll 13 for driving rotation of the roll 13. One or both of the rollers 26 and 27 may be driven. One of the rollers is mounted above the other so that the rollers can cradle a portion of the surface of the cylindrical roll of the material. The rollers are carried at a fixed position on an inclined section 16A of the frame so that the lower part 16B of the frame can pass underneath the bottom part of the roll leaving the roller 26 and 27 to engage the roll at approximately the 7 and 9 o'clock positions around the axis of the roll.

At the front of the table top is provided a further drive roller 29 which acts to carry the strip material onto the table top so that it is transported across the table top by its momentum to a further drive roller 30 at the far end of the table top 23.

Figure 3:
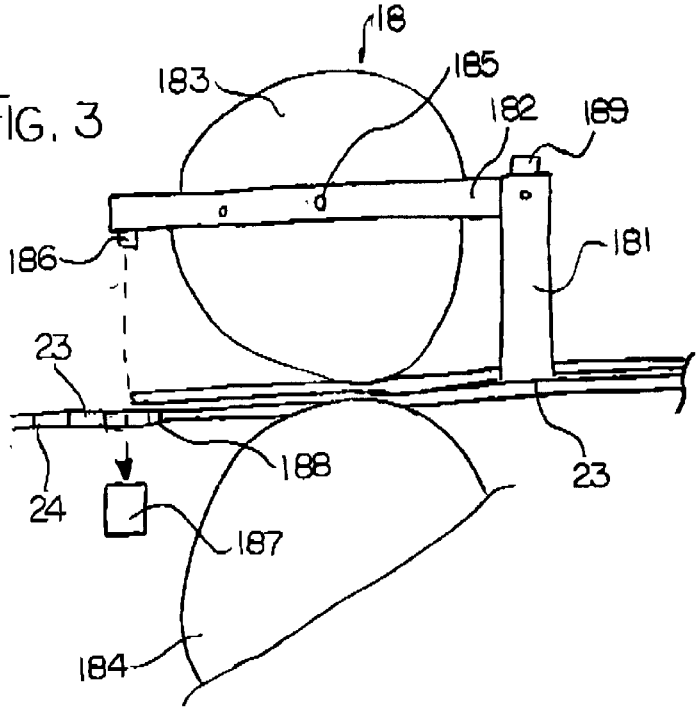
FIG. 3 is a cross sectional view of a portion only of the cutter of FIG. 1 showing the construction of the metering system.
Figure 2:
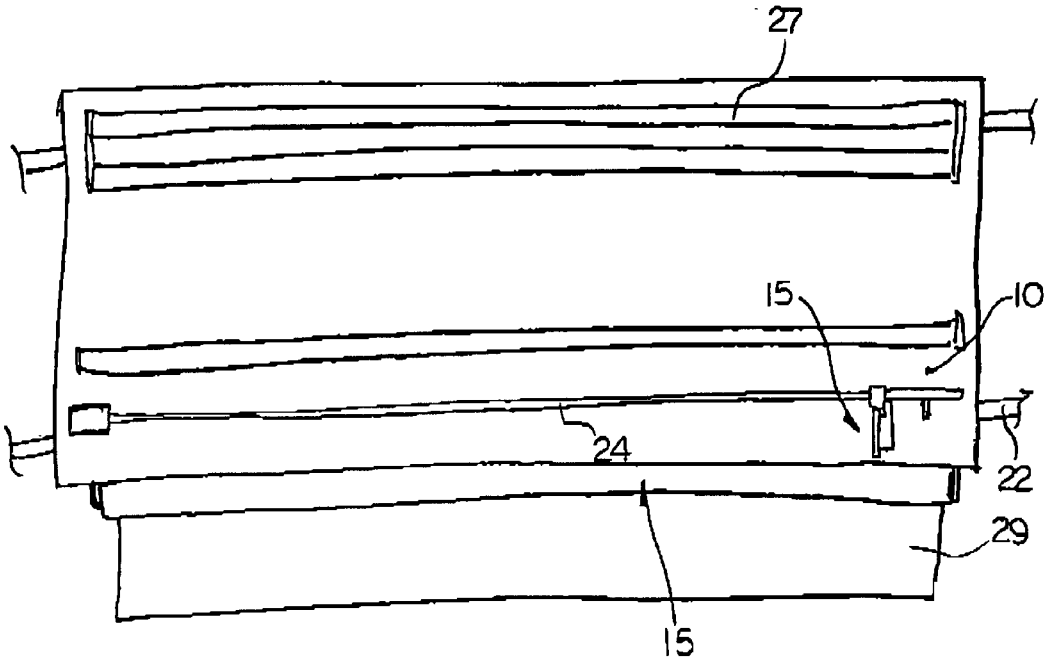
FIG. 2 is a top plan view of the cutter of FIG. 1.

On the table top 23 is provided the metering system 18 which is shown in more detail in FIG. 3. This comprises a support post 181 attached to the table top 23 and standing upwardly therefrom. A pivot arm 182 extends across the table top generally parallel to the table top and carries a top contact wheel 183 of the metering system. The arm 182 is biased into a lowered position in which the contact wheel 183 presses downwardly against the bottom metering roller 184 located at the table top 23 with an upper part of the roll 184 projecting through the table top for contacting a sheet material as it passes over the table top. Thus the sheet material is squeezed between the contact roller 183 and the metering roller 184 and as it passes through the nip formed therebetween causes rotation of the rollers 183 and 184 thus providing a metering action dependent upon the number of turns of rotation of the metering roll.

In the embodiment shown the bottom roller 184 is the metering roll and the top roller is merely a contact or pressure roller. However both rollers may act as metering rollers or the upper roller 183 may act as a metering roller with the lower roller acting merely as a contact or pressure roller against the material to form a nip.

The arm 182 carries a handle 185 by which the arm 182 and the roller 183 can be manually lifted by a pivotal action of the arm relative to the post 181 thus releasing the roller from its nipping position.

The arm 182 carries a transmitter portion 186 of an electric eye 187 with the beam passing through the table top at an opening 188 immediately upstream of the slot 24 and immediately downstream of the metering rollers. The arm 182 includes a detector schematically indicated at 89 which detects the proper positioning of the pressure roller 183 during the metering action. Thus the intention is that the metering action is monitored at all times to ensure that it is being completed and carried out effectively as the material passes through the nip between the rollers. In the event that a user, in error or deliberately, raises the roller so as to prevent the proper metering action from occurring during feeding of the sheet material then this will be detected by the sensor 189. It will be appreciated that the intention is that the length of material passing through the metering system is properly measured and cannot be changed by the user to add improperly more material than is preset to be fed.

The frame 16 further carries a control unit 35 which operates to control a label printer 36 and to control a drive mechanism 37 acting to drive the various components of the system. The control unit co-operates with a manually operable key pad 38 by which information can be input into the control unit by the operator.

In operation the frame 16 is moved into position alongside a selected one of the rolls 13 by movement along the rails and by movement transverse to the frame 19 so as to press the drive system against the roll 13 for feeding the selected sheet material onto the cutter.

The drive system is then operated by the control unit 35 through the drive 37 to drive the end 14 of the sheet material onto the cutter and across the table 23.

During this movement the electric eye 187 communicates to the control unit 35 that there is no sheet material in place on the table top. As soon as the sheet material reaches the electric eye and covers the hole 188, the presence of the sheet material is detected by the electric eye and communicated to the control unit to halt the drive system. The hole 188 is located between the metering rolls and the slot 24 of the cutter and the metering rolls are positioned as close to the cutter as possible so that the spacing therebetween is minimal. Thus the front edge of the sheet material is halted substantially at the cutting slot 24 immediately after it covers the hole 188 which is located immediately adjacent the slot 24.

This movement therefore sets up an initial position for the cutting action so that the sheet material is in position ready to be fed and re-rolled.

The user enters into the keypad a required length for the sheet material to be cut and the code information relating to the sheet material on the roll 13.

The metering system is moved to the activated position with the pressure roller 183 forming a nip with the metering roller and the sensor 189 detects that the metering system is properly in position.

With the system thus set up in the initiated condition, the operator activates the control unit through the operating pad 38 so as to start the forwarding movement of the sheet material through the metering system and into the re-roll cradle 15. The control unit acts to drive the drive system through the required length as measured by the metering system until the preset length required is close to complete whereupon the drive 37 is controlled to slow the driving movement of the driving rollers so that the sheet material moves toward completing the required length at a slower rate than the normal drive rate to prevent overshooting and to reduce momentum in the system when stopping the feeding movement of the sheet material.

Thus when the required length is completed through the metering system, the location of the end of the required length is positioned at the cutter slot 24 and the system is halted.

In the event that the detector 189 provides an indication that the metering system has been deactivated any time during this feeding motion, this is communicated as an error signal to the control unit which then invalidates the measuring of that length of material. In the event that an invalid measuring has occurred, the drive system is activated in reverse and particularly the roller 26 or 27 is driven in reverse so as to rewind the material back onto the rolls 13 for another measuring action.

In the event that the measuring is completed effectively and there has been no indication of deactivation of the measuring system by the sensor 189, the control unit 35 is activated to print a label L which carries a bar code B. The printer is generally of a conventional nature for printing information relating to the particular roll 13 selected and the length of material measured from that roll. Thus the control unit can be controlled to simply printout in human readable form and in machine readable form the material concerned and the length concerned or it can be controlled to generate further information such as a total price. In most practical examples, the user will enter into the keypad 38 a code identifying the material on the rolls 13 and the length required and these items are then printed onto the label in human readable and machine readable form for communication to the checkout for the customer taking the rolled sheet material for purchase.

When the transaction is completed and the rolled sheet material from the cradle 15 removed, the drive system again can be operated in reverse so as to rewind the material back onto the roll 13 and the frame moved to its initial storage position spaced from the carousel for commencement of a new cycle.

Instead of moving the whole carriage, one of the rollers 26 and 27 may be mounted on a lever which is moved into contact with the roll without necessity of moving the carriage toward the roll.

In the example shown, the deactivation system is used to measure or detect movement of the arm 182 which detects separation of the rollers. However other forms of sensing mechanism can be used which are responsive to separation of the rollers 183 and 184 and these will be well known to one skilled in the art.

While embodiments of the present invention has been described in the foregoing, it is to be understood that other embodiments are possible within the scope of the invention. The invention is to be considered limited solely by the scope of the appended claims.

What is claimed is:

1. Apparatus for cutting a length of sheet material from a supply of the sheet material comprising:

a carriage;

an unrolling device on the carriage for unrolling a supply roll of the sheet material, the unrolling device being driven such that a front edge of the sheet material is supplied from the roll;

a table surface on the carriage for receiving the sheet from the unrolling cradle such that the sheet passes longitudinally across the table when fed from the unrolling device;

a sheet driving roller on the carriage for driving the sheet from the unrolling device across the table;

a metering wheel on the carriage arranged to roll on the sheet as it passes from the unrolling cradle and across the table surface for measuring a length of the sheet supplied from the unrolling device;

a de-activation detector responsive to de-activation of the metering wheel;

a cutting knife mounted at the table surface and movable transversely across the table surface to slit the sheet at a position along the sheet to form a cut portion of the sheet having a required length;

a re-rolling cradle on the carriage for receiving the front edge and the cut portion and driven to roll the cut portion from the front edge into a roll for supply of the cut portion;

a material detector mounted in a path of movement of the sheet material from the unrolling device to the re-rolling cradle for detecting passage of a front edge of the sheet material and the presence of the sheet material;

a printer for printing a label recording a length of the sheet material as measured by the metering wheel;

and a control unit responsive to the detection of the front edge by the material detector to commence measuring of the length by the metering wheel to provide a measured length of the material;

the control unit being responsive to the de-activation sensor and arranged to prevent printing of a label recording the length, in the event that the de-activation sensor detects a de-activation during measuring of the length.

2. The apparatus according to claim 1 wherein the material detector comprises an electric eye.

3. The apparatus according to claim 1 wherein the material detector is mounted at the table.

4. The apparatus according to claim 1 wherein the material detector is mounted upstream of and adjacent to the cutting knife.

5. The apparatus according to claim 1 wherein the metering wheel is mounted closely adjacent to the cutting knife.

6. The apparatus according to claim 1 wherein the metering wheel is mounted immediately prior to the cutting knife.

7. The apparatus according to claim 1 wherein the metering wheel is mounted so as to contact one surface of the sheet and there is provided a second contacting wheel mounted to contact an opposed surface of the sheet.

8. The apparatus according to claim 7 wherein the de-activation sensor is arranged to detect separation of the metering wheel and the contacting wheel.

9. The apparatus according to claim 7 wherein the contacting wheel is mounted on a lever above the table and is movable on the lever to separate the contacting wheel and the measuring wheel.

10. The apparatus according to claim 9 wherein the de-activation sensor and the material sensor are mounted on the lever.

11. The apparatus according to claim 1 wherein the printer is arranged to generate a machine readable bar code containing information defining the sheet material and the length.

12. The apparatus according to claim 1 wherein the control unit is arranged to drive the unrolling device and the sheet driving roller to a predetermined length as measure by the measuring wheel .

13. The apparatus according to claim 12 wherein the control unit is arranged to slow a speed of drive of the unrolling device and the sheet driving roller as the length is approached.

14. The apparatus according to claim 1 wherein the carriage is arranged to be located adjacent a horizontal roll of the sheet material carried on a carrousel and wherein the unrolling device comprises an elongate horizontal drive roller extending along the roll parallel to an axis of the roll and movable into contact with the roll while the roll remains on the carrousel.

15. The apparatus according to claim 14 wherein the carriage is mounted on rails for movement in a direction parallel to the axis of the roll.

16. The apparatus according to claim 1 wherein the drive roller is arranged to be driven by the control unit in a reverse direction for re-rolling the sheet material onto the roll on the carrousel.

* * * * *